US006880923B2

(12) United States Patent
Lee et al.

(10) Patent No.: US 6,880,923 B2
(45) Date of Patent: Apr. 19, 2005

(54) INK CARTRIDGE

(75) Inventors: Young-su Lee, Suwon (KR); Seo-hyun Cho, Sungnam (KR); Hyung-hyu Hwang, Suwon (KR); Moo-youl Kim, Seoul (KR); Myung-song Jung, Gunno (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/438,209

(22) Filed: May 15, 2003

(65) Prior Publication Data

US 2003/0214565 A1 Nov. 20, 2003

(30) Foreign Application Priority Data

May 16, 2002 (KR) ..... 2002-27155

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | | |
|---|---|---|---|---|---|
| 5,917,525 | A | * | 6/1999 | Butty | 347/86 |
| 5,953,030 | A | * | 9/1999 | Ishinaga et al. | 347/86 |
| 5,992,988 | A | | 11/1999 | Haigo | 347/86 |
| 6,070,976 | A | | 6/2000 | Takagi et al. | 347/86 |
| 6,739,711 | B1 | * | 5/2004 | Lee et al. | 347/87 |
| 2003/0058315 | A1 | | 3/2003 | Lee et al. | 347/87 |

FOREIGN PATENT DOCUMENTS

| | | |
|---|---|---|
| EP | 0 523 635 A1 | 1/1993 |
| EP | 0 765 756 A2 | 4/1997 |
| EP | 1 092 546 A3 | 4/2001 |
| JP | 8-39821 | 2/1996 |
| JP | 11-91841 | 4/1999 |

* cited by examiner

*Primary Examiner*—Anh T. N. Vo
(74) *Attorney, Agent, or Firm*—Staas & Halsey LLP

(57) ABSTRACT

An ink cartridge includes ink chambers storing ink, a sealing member sealing the ink chambers provided with ink injection openings injecting ink into the ink chambers and air inflow openings through which the ink chambers communicate with an outside of the ink chambers, a cover member forming air inflow passageways between the air inflow openings and the outside of the ink chambers in cooperation with the sealing member and sealing the ink injection openings, an ink blocking part first blocking the ink from being discharged through the air inflow passageways in cooperation with the air inflow openings, and an ink storage part storing the ink passing through the air inflow openings and the ink blocking part to prevent the ink from being discharged through the air inflow passageways. The ink cartridge is provided with the ink blocking part and the storage part, so that suppression of ink evaporation is maximized, and the air inflow passageways maintaining a negative pressure are prevented from being clogged with flowing-back ink caused by shocks or movements of a printer during carrying of the printer or an external temperature rise, or with an inflow of minute dust and so on.

20 Claims, 6 Drawing Sheets

INK CARTRIDGE

CROSS-REFERENCE TO RELATED APPLICATIONS

This application claims the benefit of Korean Application No. 2002-27155, filed May 16, 2002, in the Korean Intellectual Property Office, the disclosure of which is incorporated herein by reference.

BACKGROUND OF THE INVENTION

1. Field of the Invention

The present invention relates to an ink cartridge for a printing machine, such as an inkjet printer, and more particularly, to an ink cartridge having air inflow passageways which are prevented from being clogged with flowing-back ink expanded by movements of the ink cartridge upon carrying the printing machine, an external temperature rise, and so on, or with an inflow of minute dust and so on upon printing.

2. Description of the Related Art

In general, a printing machine prints color images using four different ink colors, such as magenta, cyan, yellow, and black. In order to supply 4 different inks to a printer head of the printing machine upon printing, the printing machine generally uses a color ink cartridge containing the magenta, cyan, and yellow inks, and a mono or black ink cartridge containing black ink.

In FIGS. 1 and 2, a general color ink cartridge 20 for an inkjet printer is schematically illustrated.

The ink cartridge 20 is provided with three ink-containing chambers 60 corresponding to three colors of magenta, cyan, and yellow. Each of the ink-containing chambers 60 is divided into an ink chamber 60*a* as an ink reservoir, and a foam chamber 60*b* defined by a wall 83 having a communicating opening 83*a* on a lower portion thereof.

The foam chamber 60*b* is filled with a porous member 84, and a filter 71 is disposed between the porous member 84 and an ink supply port 28.

On a cover member 22 of the ink cartridge 20 are formed holes 73, 75 and a rib portion having a plurality of protrusions 72, which are spaced apart in certain intervals. The protrusions 72 provide a predetermined space between the porous member 84 and the cover member 22.

Further, a part of the ink supply port 28 is formed to protrude inside the foam chamber 60*b*.

As shown in FIG. 3, the cover member 22 has ink injection openings 74, air inflow openings 76, air inflow grooves 80 opened to an ambient atmosphere, and snake-shaped grooves 78 connecting the air inflow openings 76 to the air inflow grooves 80.

As shown in FIG. 1, the air inflow grooves 80 are sealed with a film 82 prior to use of the ink cartridge 20 and opened to an external atmosphere when the film 82 is eliminated for use. The film 82 has a tongue portion 82*a* for the film 82 to be easily removed from the cover member 22 when the cartridge 20 is used.

Operations of the ink cartridge 20 constructed with the above structure are described. First, prior to the use of the ink cartridge 20, the tongue portion 82*a* of the film 82 is pulled out and eliminated to open the air inflow grooves 80. As a result, the ink-containing chambers 60 are opened to the external atmosphere through the snake-shaped grooves 78 and the air inflow grooves 80.

Thereafter, the ink cartridge 20 is mounted on a cartridge holder (not shown) the inkjet a printer using guides 36 and fluid-communicates with a printer head (not shown). When printing starts, a negative pressure produced in the printer head causes the ink stored in the porous member 84 to be pulled toward an inside of the ink-containing chambers 60. At this time, the ink-containing chambers 60 are opened to the external atmosphere through the air inflow openings 76, snake-shaped grooves 78, and air inflow grooves 80 to maintain a constant negative pressure, so that air, dust, and the like are removed from the ink by the filter 71, and only pure ink is supplied to the printer head.

However, since the ink cartridge 20 constructed with the above structure has the fine, zigzag, and lengthy snake-shaped grooves 78 for an inflow of external air to maintain the negative pressure inside the ink cartridge 20, ink expansion caused by movements of the ink cartridge 20 upon movements of the inkjet printer or by an ambient temperature rise may cause a part or an entire part of the snake-shaped grooves 78 to be clogged with flowing-back ink.

Particularly, in a case that foreign minute dust flowing into the snake-shaped grooves 78 by the negative pressure formed by the printer head is combined and dried with the flowing-back ink, the snake-shaped grooves 78 may not provide an air inflow to the air inflow grooves 80.

As described above, in the case that the part or the entire part of the snake-shaped grooves 78 is clogged with the dried ink and/or dust and the like, the negative pressure is not produced inside the ink-containing chambers 60 even though the negative pressure for injecting the ink is produced in the printer head, so that the ink is not smoothly supplied, thereby reducing an image quality or disabling a printing process.

SUMMARY OF THE INVENTION

The present invention has been devised to solve the above and/or other problems, so it is an aspect of the present invention to provide an ink cartridge which maximizes suppression of ink evaporation and prevents air inflow passageways for maintaining a negative pressure from being clogged with flowing-back ink caused by movements of a printer during carrying the printer, an external temperature rise, and so on, or with an inflow of minute dust and so on, thereby increasing reliability of products and stability of ink injection of the printer.

Additional aspects and advantages of the invention will be set forth in part in the description which follows and, in part, will be obvious from the description, or may be learned by practice of the invention.

In order to achieve the above and/or other aspects, an ink cartridge includes one or more ink chambers storing ink, a sealing member sealing the ink chambers and provided with one or more ink injection openings through which the ink is injected into the ink chambers, and one or more first air inflow openings through which the ink chambers communicate with an outside of the ink chambers, a cover member forming air inflow passageways between the air inflow openings and the outside of the ink chambers in cooperation with the sealing member and sealing the ink injection openings, an ink blocking part forming a first part of the air inflow passageways in cooperation with the first air inflow openings and first blocking the ink from being discharged through the first air inflow openings with the air inflow openings, and an ink storage part forming a second part of the air inflow passageways connecting between the first part of the air inflow passageways formed in the ink blocking part and the outside of the ink chambers, and storing the ink passing the ink blocking part.

According to an aspect of the invention, the ink blocking part includes first cylindrical protrusions formed on the cover member to be inserted into the first air inflow openings, and minute gaps formed on the first cylindrical protrusions, on inner walls defining the air inflow openings, or between the first cylindrical protrusions and the inner walls, through which the ink chambers and the ink storage part communicate with each other when the first cylindrical protrusions are inserted into the first air inflow openings.

The ink storage part includes first walls formed on the sealing member to protrude upward and surrounding the air inflow openings to define an ink storage space and to prevent ink from passing when the sealing member is sealed by the cover member, second air inflow openings formed on an upper side of the first walls to form a second part of the air inflow passageways, and ink/dust blocking members disposed between the second air inflow openings and the ink blocking part to prevent flowing-in dust from flowing into the ink blocking part from the outside of the chambers while preventing the ink passing the ink blocking part from being externally discharged.

The second air inflow openings are disposed in a different direction from a movement direction of the printer head to prevent the dust from flowing in the ink chambers due to movements of the printer head upon printing. Further, the ink/dust blocking members include second walls having communicating openings to divide the ink storage space into two small spaces.

Further, the cover member includes second cylindrical protrusions formed to be inserted into the ink injection openings and protruding around the ink injection openings of the sealing member to seal off the ink injection openings from the outside of the ink chambers, and a grip portion extended outward the cartridge to easily separate the first and second cylindrical protrusions from the first air inflow openings and the ink injection openings, respectively.

Fusion guides are formed on respective upper ends of the first and second walls of the sealing member to easily seal the cover member and the sealing member.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
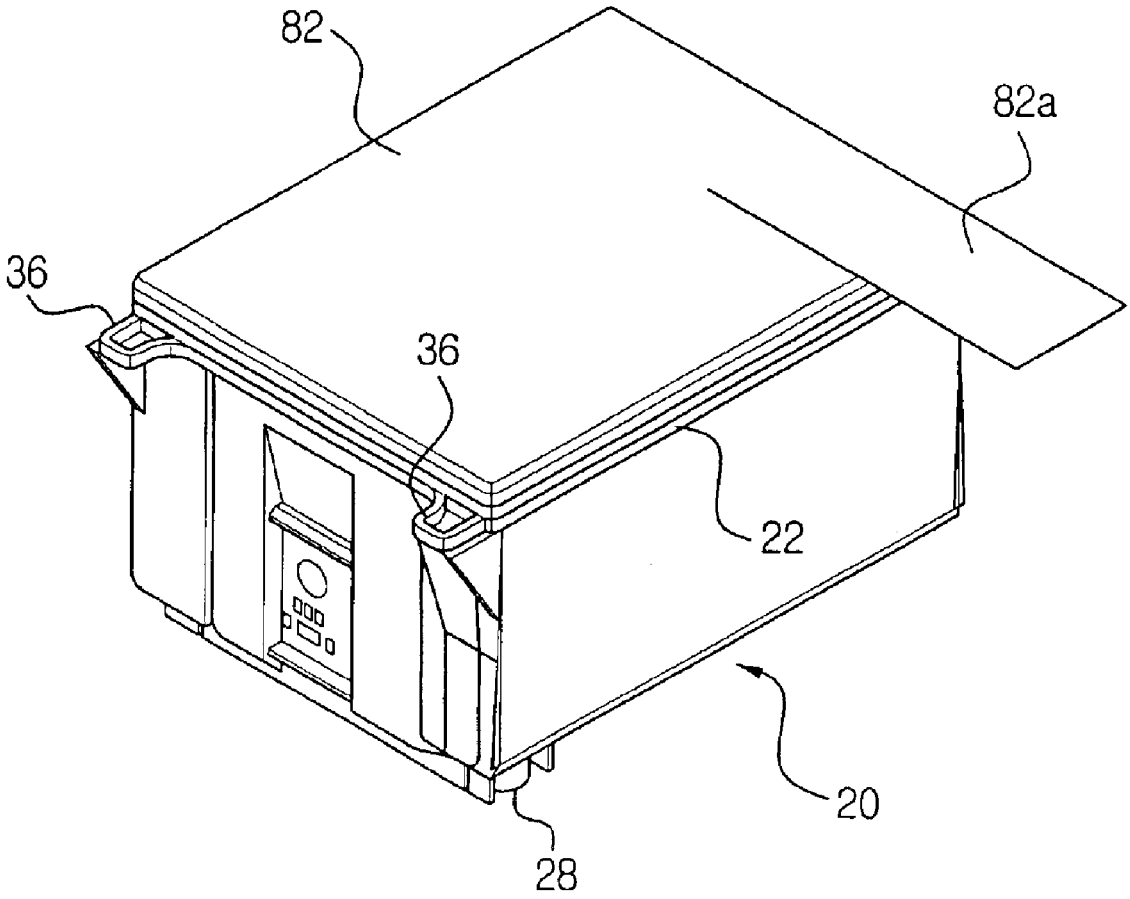
FIG. 1 (PRIOR ART)
FIG. 1 is a perspective view of a conventional ink cartridge.
Figure 2:
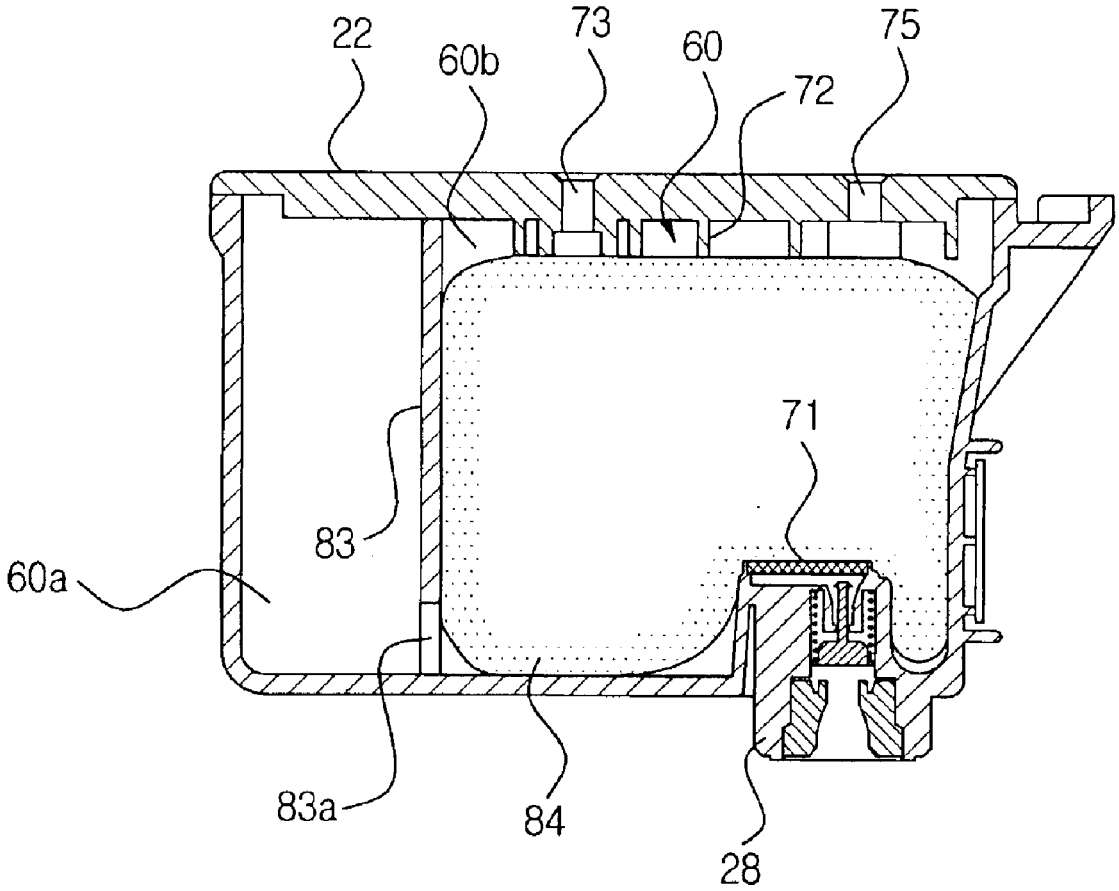
FIG.2 (PRIOR ART)
FIG. 2 is a cross-sectioned view of the ink cartridge shown in FIG. 1.
Figure 3:
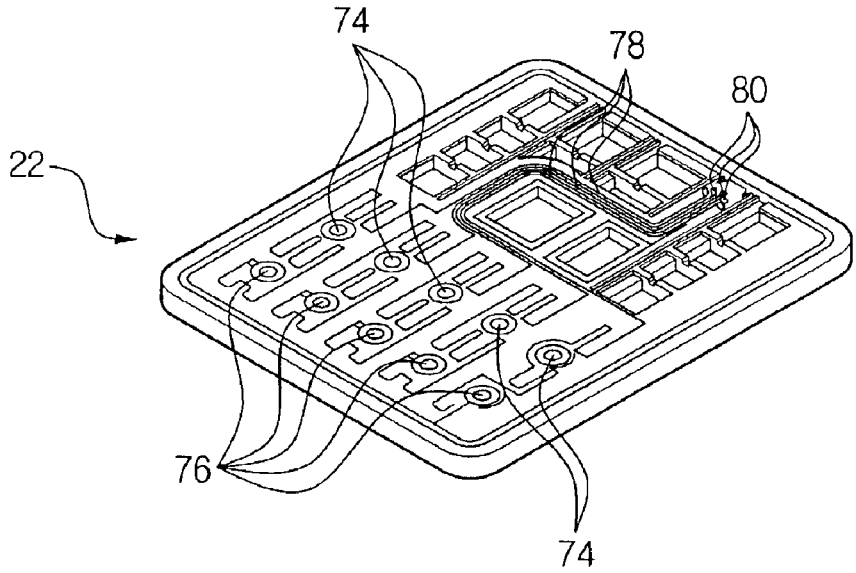
FIG.3 (PRIOR ART)
FIG. 3 is a perspective view of a cover member of the ink cartridge shown in FIG. 1.

Reference will now be made in detail to the present preferred embodiment of the present invention, examples of which are illustrated in the accompanying drawings, wherein like reference numerals refer to the like elements throughout. The embodiment is described below in order to explain the present invention by referring to the figures.

Figure 4:
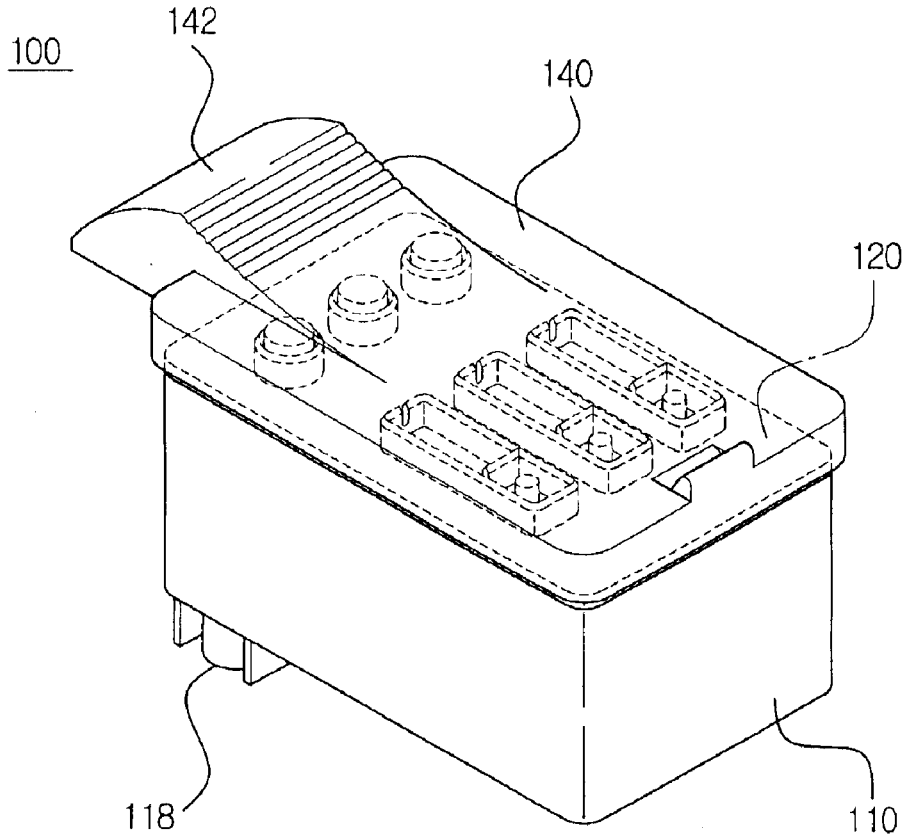
FIG. 4 is a perspective view of an ink cartridge according to an embodiment of the present invention.

Referring to FIG. 4, a color ink cartridge 100 according to an embodiment of the present invention is schematically illustrated.

The ink cartridge 100 has a body 110 having three main chambers (not shown) containing three different color inks of magenta, cyan, and yellow.

Each of the three main chambers inside the body 110 is divided into an ink chamber (not shown) and a foam chamber (not shown), and an ink supply port 118 is formed in a lower portion of the foam chamber. A detailed structure of the ink chambers is the same as that of a conventional ink cartridge 20 shown in FIG. 1, so a detailed description on the ink chambers will be omitted.

Figure 5:
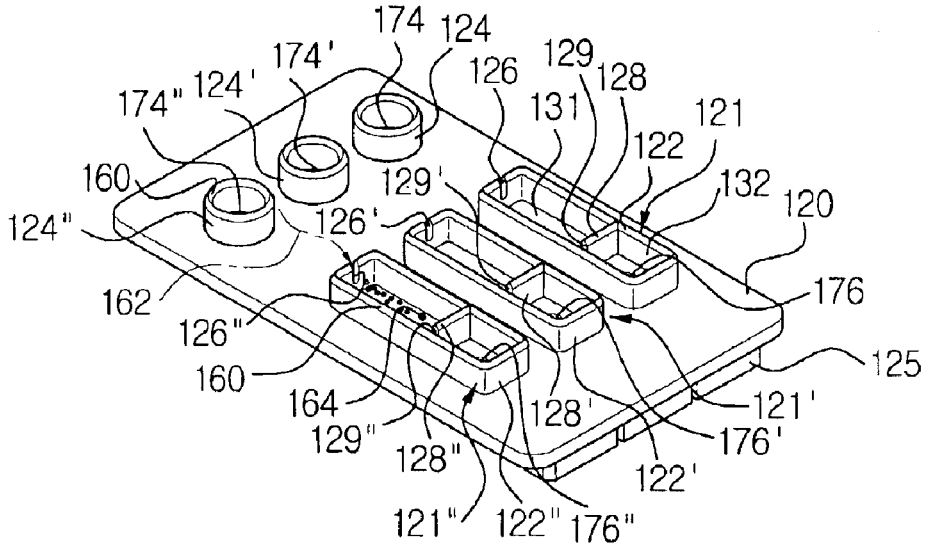
FIG. 5 is a perspective view of a sealing member of the ink cartridge shown in FIG. 4.

To an upper side of the body 110 is coupled a sealing member 120 sealing the three ink chambers through a fixing protrusion 125 downwardly protruding along peripheral edges of the sealing member 120 as shown in FIG. 5.

As shown in detail in FIGS. 5 and 7 through 9, the sealing member 120 is constructed with a flat plate having three first air inflow openings 176, 176', and 176" through which the respective ink chambers communicate with an outside of the ink chambers, and three ink injection openings 174, 174', and 174" through which the ink is injected into the ink chambers.

Figure 6:
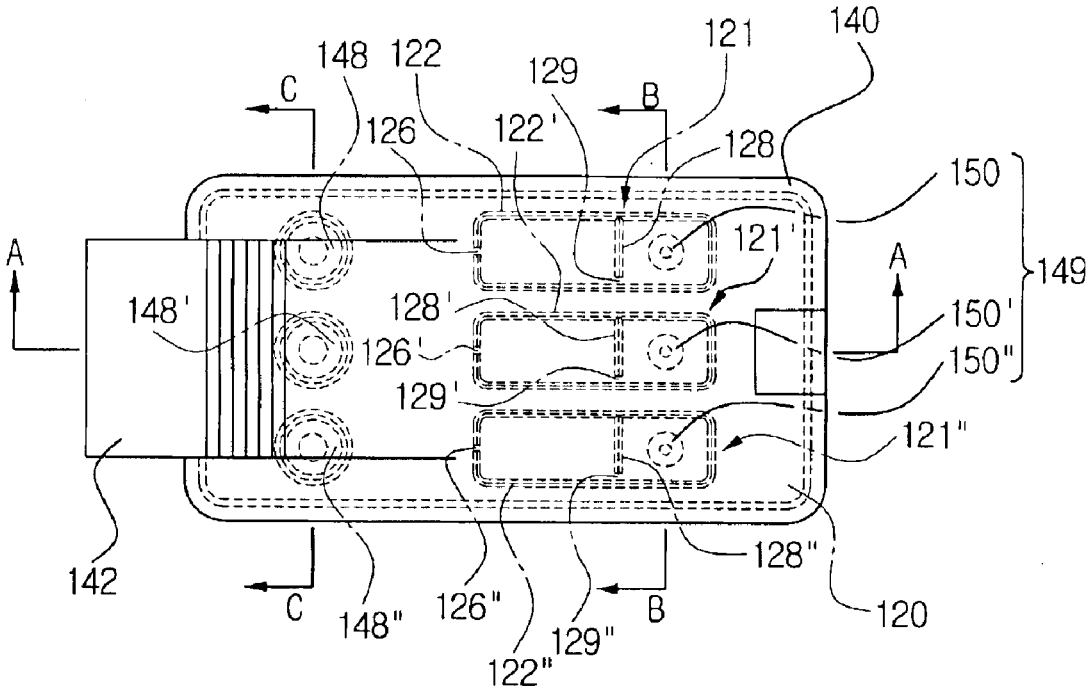
FIG. 6 is a plan view of the sealing member and a cover member of the ink cartridge shown in FIG. 4.

Into the first air inflow openings 176, 176', and 176" of the sealing member 120 are inserted first cylindrical protrusions 150, 150', and 150" formed in a cover member 140, which will be later described, to first block discharging of the ink expanded by a shock or movements of the ink cartridge 100 or by an external temperature rise through the first air inflow openings 176, 176', and 176". The first cylindrical protrusions 150, 150', and 150" of the cover member 140 form a portion of an ink blocking part 149 (refer to FIGS. 6 and 8) which will be later described in detail.

Further, ink storage parts 121, 121', and 121" are formed on the sealing member 120 around the first air inflow openings 176, 176', and 176", respectively.

As shown in FIG. 5, the ink storage parts 121, 121', and 121" include rectangular walls 122, 122', and 122" upwardly protruding around the first air inflow openings 176, 176', and 176", second air inflow openings 126, 126', and 126", through which external air 162 flows into the ink chambers, formed on one side of the rectangular walls 122, 122', and 122", and ink/dust blocking members 128, 128', and 128" disposed between the second air inflow openings 126, 126', and 126" and the ink blocking part 149 inside the rectangular walls 122, 122', and 122".

The rectangular walls 122, 122', and 122" form respective ink or dust storage spaces to store the ink flowing back through the ink blocking part 149 when the sealing member 120 is sealed by the cover member 140.

The second air inflow openings 126, 126', and 126" are formed on an upper side of the rectangular walls 122, 122', and 122" to prevent the ink flowing back into the ink storage parts 121, 121', and 121" from being externally discharged with ease through the ink blocking part 149.

Further, the second air inflow openings 126, 126', and 126" are disposed in a different direction from a movement direction of a printer head on the ink cartridge 100, for example, in a direction not opposite to the movement direction of the printer head, to prevent ambient dust from flowing in the ink chambers by movements of the printer head (not shown) during printing.

The ink/dust blocking members 128, 128', and 128" are constructed with walls having communicating openings 129, 129', and 129" to divide respective ink storage spaces into two small spaces. The ink/dust blocking members 128, 128', and 128" prevent dust 164, which flows in the small spaces from the outside of the ink chambers through the second air inflow openings 126, 126', and 126", from flowing into the first air inflow openings 176, 176', and 176" and the ink blocking part 149, and block the ink passing through the second air inflow openings 176, 176', and 176" and the ink blocking part 149 to prevent the ink from being externally discharged.

As described above, the ink storage parts 121, 121', and 121" delay ink evaporation to the utmost, store the ink first passing through the first air inflow openings 176, 176', and 176" and the ink blocking part 149 not to be externally discharged, and, at the same time, block the external dust 164 from flowing into the ink chambers.

Further, on the sealing member 120 around the ink injection openings 174, 174', and 174" is formed cylindrical walls 124, 124', and 124" respectively protruding to accommodate second cylindrical protrusions 148, 148', and 148" of the cover member 140, which will be later described, to seal off the ink injection openings 174, 174', and 174".

Figure 7:
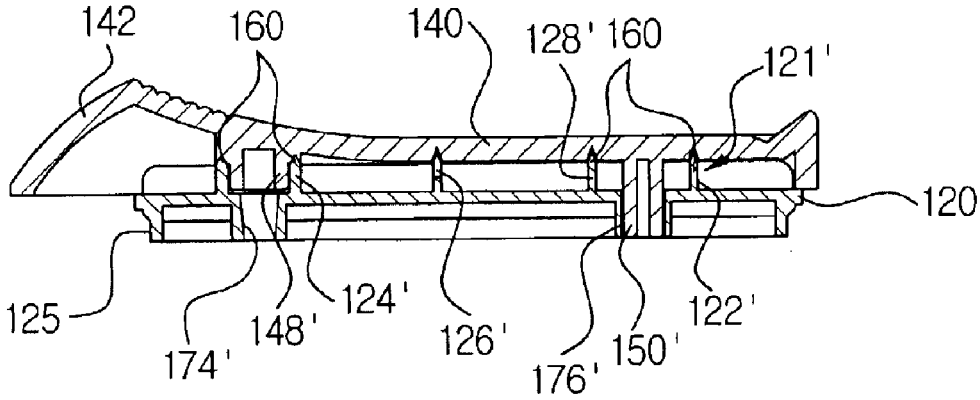
FIG. 7 is a cross-sectioned view taken along line A—A of FIG. 6.

As shown in FIGS. 4 and 7, the cover member 140 disposed on the sealing member 120 has the second cylindrical protrusions 148, 148', and 148" formed to be inserted into the cylindrical walls 124, 124', and 124" formed to upwardly protrude from an upper side of the sealing member 120 around the ink injection openings 174, 174', 174" to seal off the ink injection openings 174, 174', and 174" from the outside of the ink chambers, and a tongue portion or a grip portion 142 outwardly extended from the body 110 to easily separate first cylindrical protrusions 150, 150', and 150" and the second cylindrical protrusions 148, 148', and 148" from the air inflow openings 176, 176', and 176" and the ink injection openings 174, 174', and 174", respectively, for an ink refill or when a problem occurs in the ink cartridge 100.

Further, the cover member 140, as stated above, has the ink blocking part 149 formed to be inserted into the first air inflow openings 176, 176', 176" to prevent ink from being discharged through the first air inflow openings 176, 176', and 176", thereby blocking the ink.

Figure 8:
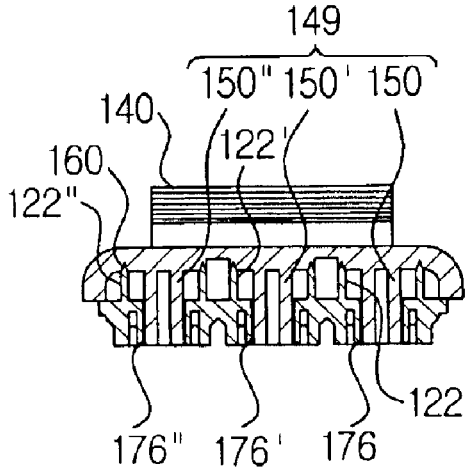
FIG. 8 is a cross-sectioned view taken along line B—B of FIG. 6.
Figure 9:
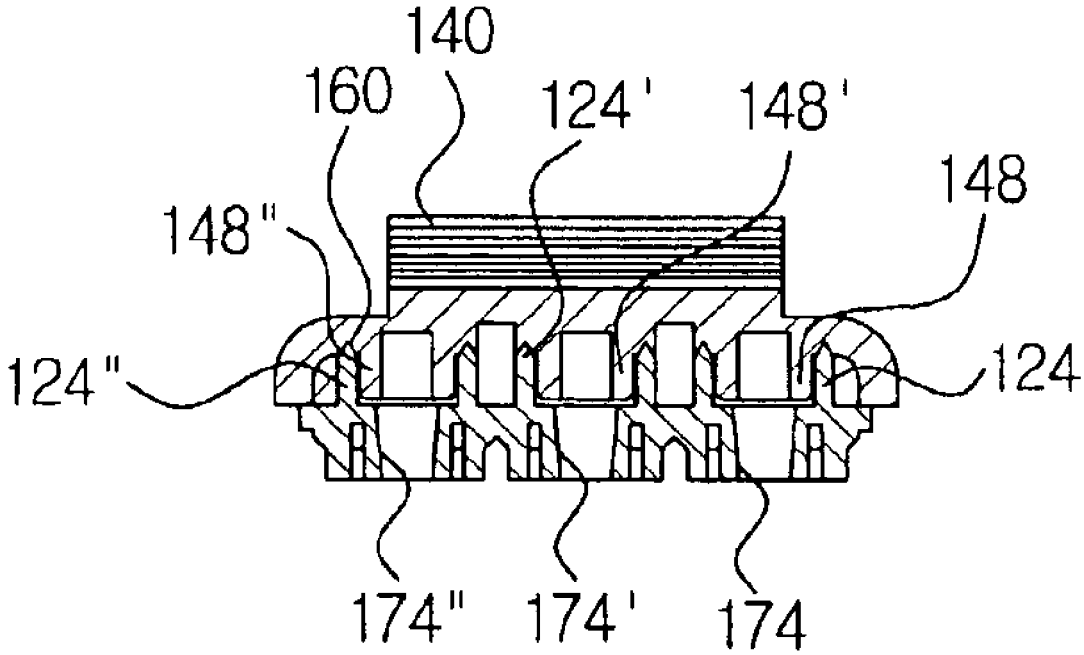
FIG. 9 is a cross-sectioned view taken along line C—C of FIG. 6.

As shown in FIGS. 7 and 8, the ink blocking part 149 is constructed with the first cylindrical protrusions 150, 150', and 150" protruding from a bottom of the cover member 140 to be inserted into the first air inflow openings 176, 176', and 176", and minute grooves or gaps (not shown) vertically formed a bit longer than a vertical length of the first air inflow openings 176, 176', and 176" along outer circumferences of the first cylindrical protrusions 150, 150', and 150" so that the ink chambers and the ink storage parts 121, 121', and 121" communicate with one another when the first cylindrical protrusions 150, 150', and 150" are inserted into corresponding ones of the first air inflow openings 176, 176', 176".

Alternatively, the minute gaps of the ink blocking part 149 may be vertically formed in inner circumferences of inner walls defining the first air inflow openings 176, 176', and 176" instead of the outer circumferences of the first cylindrical protrusions 150, 150', and 150".

Further, another shaped-gap other than the minute gaps having the above shapes may be formed on one of the inner walls of the first air inflow openings 176, 176', and 176" and the outer circumferences of the first cylindrical protrusions 150, 150', 150" so that the first inflow openings 176, 176', and 176" are prevented from being clogged with the dust and the ink even though the passing ink is dried. For example, minute annular gaps may be formed between the first cylindrical protrusions 150, 150', and 150" and the inner walls of the first air inflow openings 176, 176', and 176". Here, outer diameters of the first cylindrical protrusions 150, 150', and 150" are smaller than inner diameters of the first air inflow openings 176, 176', and 176". As an another example, minute hollow openings, through which inner hollow portions of the first cylindrical protrusions 150, 150', and 150" communicate with the ink storage parts 121, 121', and 121," may be formed on upper sides of the first cylindrical protrusions 150, 150', and 150" where the first cylindrical protrusions 150, 150', and 150" are not in contact with the inner walls of the first air inflow openings 176, 176', and 176" when the first cylindrical protrusions 150, 150', and 150" are inserted into the first air inflow openings 176, 176', and 176".

As described above, the cover member 140 cooperates with the first air inflow openings 176, 176', and 176" to form the air inflow passageways between the first air inflow openings 176, 176', and 176" and the outside of the ink chambers as well as to seal the ink injection openings 174, 174', and 174".

To seal between the cover member 140 and the sealing member 120 after the cover member 140 is coupled to the sealing member 120, that is, after the first and second cylindrical protrusions 150, 150', and 150" and 148, 148', and 148" are inserted into corresponding ones of the ink injection openings 174, 174', and 174" and the first air inflow openings 176, 176', and 176". On the upper ends of the cylindrical walls 124, 124', and 124" and the rectangular walls 122, 122', and 122" of the sealing member 120 are formed fusion guides 160 having a triangular cross section to be fused on the bottom of the cover member 140 upon ultrasonic fusion.

Accordingly, when the first and second cylindrical protrusions 150, 150', and 150" and 148, 148', and 148" of the cover member 140 are inserted into corresponding ones of the ink injection openings 174, 174', and 174" and the first air inflow openings 176, 176', and 176", the fusion guides 160 of the sealing member 120 are ultrasonically fused to the bottom of the cover member 140. The air inflow passageways having a lower space of the grip portion 142 of the cover member 140, the second air inflow openings 126, 126', and 126", the communicating openings 129, 129', and 129", and the minute gaps of the ink blocking part 149 are formed between the respective ink chambers and the outside of the ink chambers.

In order to prevent the ink from being evaporated through the air inflow passageways prior to use of the ink cartridge 100, the lower space of the grip portion 142 of the cover member 140 forming an entrance of the air inflow passageways is sealed by an appropriate sealing film.

As stated above, only the color ink cartridge 100 has been described according to the embodiment of the present invention, but the present invention is not limited thereto. That is, the present invention may be applied even to a black ink cartridge.

Operations of the color ink cartridge 100 structured as above according to the present invention will be described in detail as below with respect to FIGS. 4 through 9.

First, prior to the use of the ink cartridge 100, the sealing film sealing the entrance of the lower space of the grip portion 142 of the cover member 140 is removed. At this time, the ink chambers for three colors of magenta, cyan, and yellow are respectively open to the atmosphere through the air inflow passageways formed with the lower space of the grip portion 142 of the cover member 140, the second air inflow openings 126, 126', 126", the communicating openings 129, 129', and 129", and the minute gaps of the ink block part 149.

Next, when the ink cartridge 100 is mounted in a cartridge holder (not shown) of the printer to fluid-communicate with the printer head, and printing is started, a negative pressure produced by the printer head draws the inks stored in the ink chambers.

At this time, the external air 162, as shown in FIG. 5, flows into the ink chambers through the lower space of the grip portion 142 of the cover member 140 and the second air inflow openings 126, 126', and 126". The walls 128, 128', and 128" remove dust 164 and so on from the outside of the ink chambers. Thereafter, the external air 162 is supplied to the respective ink chambers through the communicating openings 129, 129', and 129" and the minute gaps of the ink blocking part 149. As a result, the negative pressure is maintained constant in the ink chambers so that the ink is supplied to the printer head.

In a case that the ink chambers are refilled after the ink in the ink cartridge 100 has been consumed or problems, such as the clogging of the ink cartridge 100 and so on, occur, the grip portion 142 is lifted up to separate the bottom of the cover member 140 from the fusion guides 160 of the cylindrical walls 124, 124', and 124" and the rectangular walls 122, 122', and 122", so the ink injection openings 174, 174', and 174" and the first air inflow openings 176, 176', and 176" of the sealing member 120 can be opened to inject new ink into the ink chambers, thereby solving the problems, such as the clogging of the ink cartridge 100 and so on.

Further, in a case that the ink inside the ink cartridge 100 expands due to the movements of the printer upon carrying the printer or external temperature rise, the ink flows back through the minute gaps of the ink blocking part 149. The flowing-back ink is blocked by the walls 128, 128', and 128" of the ink storage parts 121, 121', and 121" so that the ink is not externally discharged but temporarily stored in ink storing portions 132 of the ink storage parts 121, 121', and 121". Thereafter, if the ink is recovered to its normal state, the ink stored in the ink storage parts 121, 121', and 121" is returned to the ink chambers through the minute grooves (gaps). At this time, the respective ink chambers containing the inks of the different colors have the corresponding ink storage parts 121, 121', and 121", so that the inks are not mixed up.

As described above, the ink cartridge according to the present invention provides an effect that maximizes suppression of ink evaporation and prevents the air inflow passageways maintaining the negative pressure constant from being clogged with the flowing-back ink caused by the movements of the printer during carrying the printer, external temperature rise, and so on, or with the inflow of minute dust and so on.

Although the preferred embodiment of the present invention has been described, it will be understood by those skilled in the art that the present invention should not be limited to the described preferred embodiment, but various changes and modifications can be made within the spirit and scope of the present invention as defined by the appended claims and their equivalents.

What is claimed is:

1. An ink cartridge comprising:

one or more ink chambers storing ink;

a sealing member sealing the ink chambers and provided with one or more ink injection openings, through which the ink is injected into the ink chambers, and one or more first air inflow openings, through which the ink chambers communicate with an outside of the ink chambers;

a cover member forming air inflow passageways between the first air inflow openings and the outside of the ink chambers with the sealing member and sealing the ink injection openings; and an ink blocking part formed to correspond to each of the air inflow passageways, forming a first part of the air inflow passageways in cooperation with the first air inflow openings, and disposed in the first air inflow openings to block the ink from being discharged through the first air inflow openings in cooperation with the first air inflow openings.

2. The ink cartridge as claimed in claim 1, further comprising:

an ink storage part forming a second part of the air inflow passageways connecting the first part of the air inflow passageways formed in the ink blocking part to the outside of the ink chambers, and storing the ink passing through the ink blocking part.

3. The ink cartridge as claimed in claim 2, wherein the sealing member comprises inner walls defining corresponding ones of the first air inflow openings, and the ink blocking part comprises:

first cylindrical protrusions formed on the cover member to be inserted into the first air inflow openings; and gaps formed on one of the first cylindrical protrusions and the inners walls or between the first cylindrical protrusions and the inner walls of the first air inflow openings to allow the ink chambers and the ink storage part to communicate with each other when the first cylindrical protrusions are inserted into the first air inflow openings.

4. The ink cartridge as claimed in claim 3, wherein the ink storage part comprises:

first walls formed to protrude on the sealing member toward the cover member, and surrounding the air inflow openings to define an ink storage space and to prevent the ink from passing toward the outside of the ink chambers when the sealing member is sealed by the cover member;

second air inflow openings formed on a side of the first walls to couple the first air inflow openings to the outside of the ink chambers; and ink/dust blocking members disposed between the second air inflow openings and the ink blocking part to prevent flowing-in dust from flowing into the ink blocking part from the outside of the chambers while preventing the ink passing through the gaps from being externally discharged.

5. The ink cartridge as claimed in claim 4, wherein the ink cartridge comprises a printer head coupled to the ink chambers, and the second air inflow openings are disposed in a different direction from a movement direction of the printer head to prevent dust from flowing in the ink blocking part due to the movement of the printer head upon printing.

6. The ink cartridge as claimed in claim 5, wherein the ink/dust blocking members comprise:

second walls having communicating openings to divide the ink storage space into two spaces corresponding to respective ones of the first air inflow openings and the second air inflow openings.

7. The ink cartridge as claimed in claim 6, wherein the cover member comprises:

second cylindrical protrusions needed to be inserted into the ink injection openings, protruding toward the ink injection openings of the sealing member to seal off the ink injection openings; and a grip portion extended outward of the ink cartridge to separate the first and second cylindrical protrusions from corresponding ones of the air inflow openings and the ink injection openings.

8. The ink cartridge as claimed in claim 7, wherein the seal member comprises:

fusion guides formed on corresponding ends of the first and second walls of the sealing member to seal the cover member and the sealing member.

9. An ink cartridge comprising:

a body defining an ink chamber storing ink;

a sealing member forming a side of the body to seal the ink chamber, and provided with a first inner wall defining an ink injection opening, through which the ink is injected into the ink chamber, and a second inner wall defining a first air inflow opening, through which the ink chamber communicates with an outside of the ink chamber;

a cover member sealing the ink injection opening and the first air inflow opening of the seal member, and forming a passageway between the first air inflow opening and the outside of the ink chamber with the sealing member; and a wall disposed between the cover member and the seal member to surround the second inner wall to block the ink passing the first air inflow opening from being discharged to the outside of the ink chamber, and having a second air inflow opening to form a part of the passageway to allow external air to be introduced into the passageway from the outside of the ink chamber; and an ink/dust blocking member disposed between the sealing member and the cover member and within the wall to divide the ink passageway into an ink storage part and a dust storage part.

10. The ink cartridge as claimed in claim 9, wherein the ink/dust blocking member comprises:

a communicating hole forming a second part of the passageway to allow the ink storage part and the dust storage part to communicate with each other.

11. The ink cartridge as claimed in claim 9, wherein the wall comprises:

a first sidewall disposed in a direction from the first air inflow opening to the ink injection opening.

12. The ink cartridge as claimed in claim 11, wherein the wall comprises a second sidewall formed between ends of the first sidewall and disposed between the first air inflow opening and the ink injection opening.

13. The ink cartridge as claimed in claim 12, wherein the second air inflow opening is formed on the second sidewall of the wall.

14. The ink cartridge as claimed in claim 12, wherein the ink cartridge is movably mounted in a printer in a first direction, and the second air inflow opening is formed in a second direction other than the first direction.

15. The ink cartridge as claimed in claim 9, wherein the sealing member comprises:

a fixing protrusion fixedly coupling the seal member to the body to form the side of the body.

16. The ink cartridge as claimed in claim 9, wherein the cover member comprises:

a rim protruding from the cover member toward the seal member to couple the cover member to the seal member while the wall is disposed between the seal member and the cover member.

17. The ink cartridge as claimed in claim 9, wherein the cover member comprises:

a hand grip formed on a portion of the cover member.

18. The ink cartridge as claimed in claim 17, wherein the hand grip of the cover member comprises:

a side defining a recess to communicate, with the second air inflow opening.

19. The ink cartridge as claimed in claim 18, wherein the cover member comprises:

a film attached to the side of the hand grip to seal the recess.

20. An ink cartridge comprising:

a body defining a plurality of ink chambers storing corresponding ones of ink;

a sealing member forming a side of the body to seal the ink chambers, and provided with a plurality of first inner walls defining respective injection openings, through which the corresponding ink is injected into corresponding ones of the ink chambers, and a plurality of second inner walls defining respective first air inflow openings, through which the ink chambers communicate with an outside of the ink chamber, respectively;

a cover member sealing the ink injection openings and the air inflow openings of the seal member, and forming passageways between the air inflow openings and corresponding ones of the outside of the ink chamber with the sealing member;

a plurality of walls disposed to form corresponding ones of the passageways between the cover member and the seal member to surround respective ones of the second inner walls to block the ink passing corresponding ones of the air inflow openings from being discharged to the outside of the ink chamber, the walls having second air inflow openings to form a part of the passageways and allow external air to be introduced into the passageways from the outside, and isolating the passageways from each other;

a first cylindrical protrusion formed on the cover member to be inserted into the second inner wall; and a gap formed on one of the first cylindrical protrusion and the second inner wall of the first air inflow opening or between the first cylindrical protrusion and the second inner wall to allow the ink chamber and the second air inflow opening to communicate with each other when the first cylindrical protrusion is inserted into the second inner wall.

* * * * *

UNITED STATES PATENT AND TRADEMARK OFFICE

CERTIFICATE OF CORRECTION

PATENT NO. : 6,880,923 B2
DATED : April 19, 2005
INVENTOR(S) : Young-su Lee et al.

It is certified that error appears in the above-identified patent and that said Letters Patent is hereby corrected as shown below:

Column 8,
Line 40, change “inners” to -- inner --.

Column 10,
Line 20, after “communicate” delete “,”.

Signed and Sealed this

Twenty-fourth Day of January, 2006

JON W. DUDAS
*Director of the United States Patent and Trademark Office*